US006223902B1

(12) United States Patent
Gale

(10) Patent No.: US 6,223,902 B1
(45) Date of Patent: May 1, 2001

(54) PACKAGING FOR GLASSES HAVING STEMS AND BASE AND TOP PLATFORMS FOR USE THEREWITH

(76) Inventor: Gregory W. Gale, 3380 Atlas Peak Rd., Napa, CA (US) 94558

( * ) Notice: Subject to any disclaimer, the term of this patent is extended or adjusted under 35 U.S.C. 154(b) by 0 days.

(21) Appl. No.: 09/385,911

(22) Filed: Aug. 30, 1999

(51) Int. Cl.[7] ..... B65D 81/02
(52) U.S. Cl. ..... 206/592; 206/433
(58) Field of Search ..... 206/433, 431, 206/588, 589, 591, 592, 593, 594, 203

(56) References Cited

U.S. PATENT DOCUMENTS

| | | | | |
|---|---|---|---|---|
| 2,580,043 | * | 12/1951 | Paige | 206/433 X |
| 4,911,300 | * | 3/1990 | Colonna | 206/433 X |
| 5,248,035 | * | 9/1993 | Gallagher | 206/427 |
| 5,421,477 | * | 6/1995 | Hammett | 206/431 X |

* cited by examiner

*Primary Examiner*—Luan K. Bui
(74) *Attorney, Agent, or Firm*—Flehr Hohbach Test Albritton & Herbert LLP

(57) ABSTRACT

Packaging for glasses having stems, the glasses each having a base, a stem mounted on the base and an open bowl mounted on the stem. A case in the form of a parallelepiped is provided having parallel spaced-apart side walls and parallel spaced-apart end walls adjoining the side walls and top and bottom closures to provide an enclosed space for a plurality of juxtaposed glasses disposed in the space within the case. A base platform is provided having a plurality of spaced-apart wells for receiving the bases of the glasses. A top platform is provided having a plurality of spaced-apart wells receiving the bowls of the glasses. Each of the base platform and the top platform have a plurality of pedestals disposed between the wells and are formed integral therewith. The pedestals have a height so that the pedestals are in engagement with each other to provide support for the glasses to protect the glasses and particularly the stems of the glasses against compressive forces applied to the case and to the base and top platforms to inhibit breakage of the stems of the glasses.

14 Claims, 3 Drawing Sheets

PACKAGING FOR GLASSES HAVING STEMS AND BASE AND TOP PLATFORMS FOR USE THEREWITH

This invention relates to packaging for glasses having stems and base and top platforms for use therewith.

Packaging has heretofore been provided for shipping of glasses having stems. However, such packaging has been less than satisfactory because of the breakage of the stems of such glasses during shipment. There is therefore a need for new and improved packaging for glasses having stems overcoming these breakage problems.

In general, it is an object of the present invention to provide packaging for glasses having stems and base and top platforms for use therewith which provides support for the stems of the glasses to inhibit breaking of the stems.

Another object of the invention is to provide base and top platforms for use in packaging which are made of molded fiber.

Another object of the invention is to provide base and top platforms of the above character which are provided with support pedestals in engagement with each other to provide support against compression of the glasses having stems.

Another object of the invention is to provide base and top platforms of the above character which can be economically manufactured.

Another object of the invention is to provide packaging of the above character which can be utilized with conventional packaging machinery.

Additional objects and features of the invention will appear from the following description in which the preferred embodiments are set forth in detail in conjunction with the accompanying drawings.

In general, the packaging for glasses having long stems is for use with glasses of the type each having a base, a stem mounted on the base and an open bowl mounted on the stem. The packaging consists of a case in the form of a parallelepiped receiving a plurality of the glasses in juxtaposed positions within the case. The case has spaced-apart parallel side and end walls and bottom and tp closures. A base platform is disposed in the case on the bottom closure and has a plurality of spaced-apart recesses therein receiving the bases of the plurality of juxtaposed glasses. A top platform is disposed over the tops of the glasses and has a plurality of spaced-apart recesses receiving the bowls of the glasses. Each of the base platform and the top platform have a plurality of pedestals carried thereby. The pedestals of the base platform and the top platform have heights whereby when the base platform is positioned to receive the bases of the glasses and the top platform is positioned to receive the bowls of the glasses, the pedestals of the base platform and the top platform are in engagement with each other to provide support against compression of the stems of the glasses to aid in inhibiting breakage of the stems of the glasses.

Figure 1:
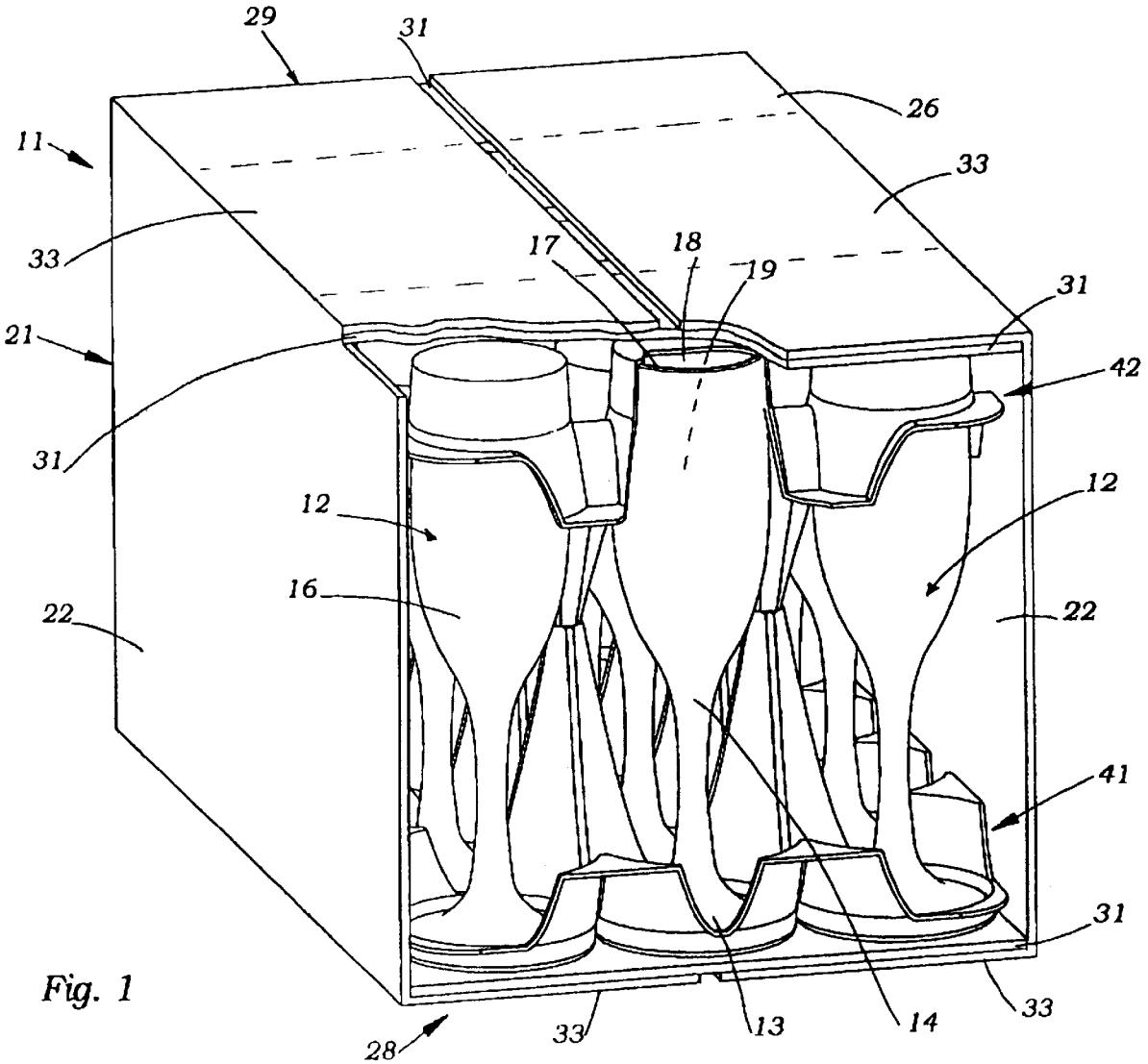
FIG. 1 is an isometric view of packaging for glasses having stems and incorporating base and top platforms of the present invention in a case with a portion of the case forming the packaging being broken away.
Figure 2:
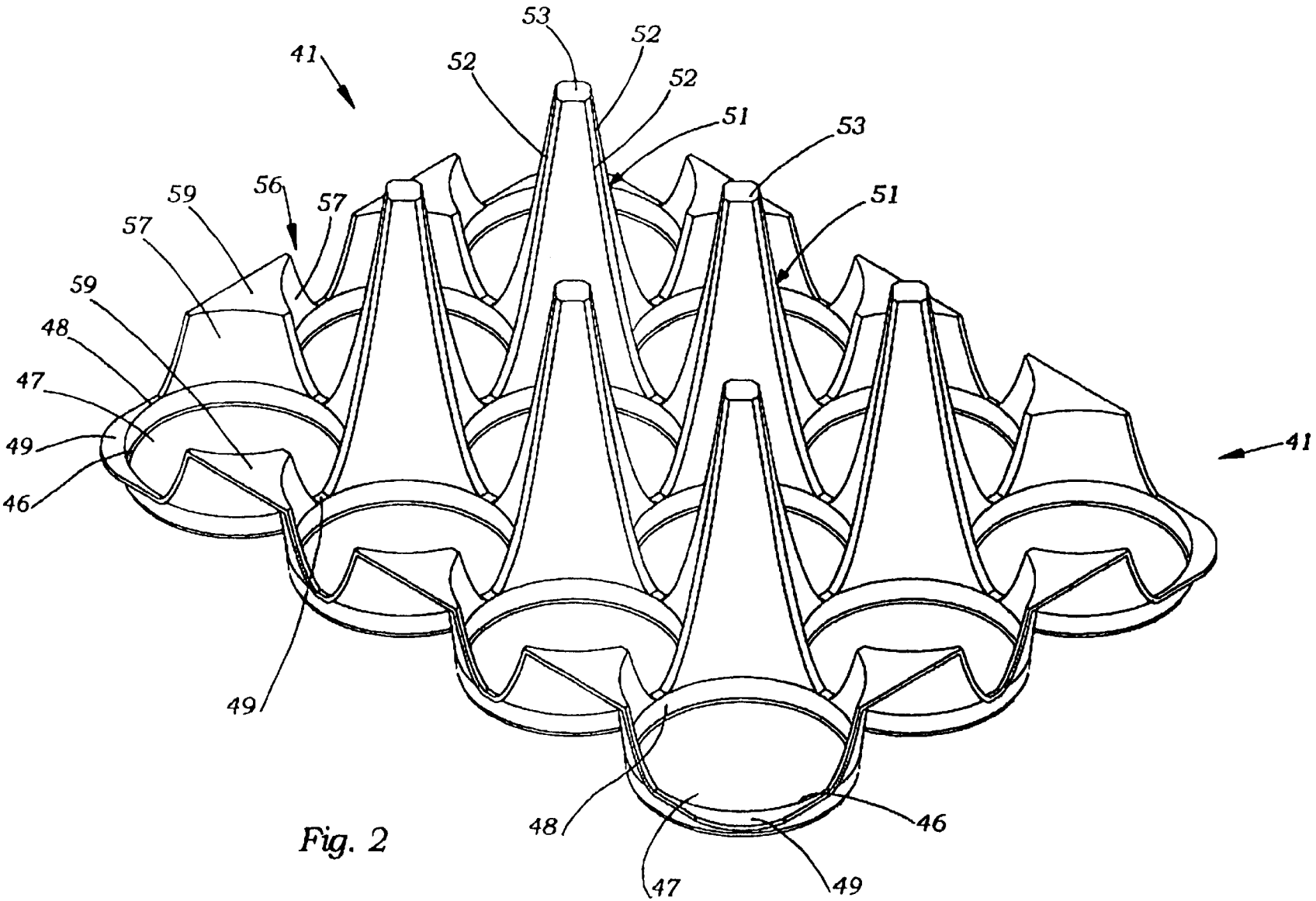
FIG. 2 is an isometric view of the base platform shown in FIG. 1.
Figure 3:
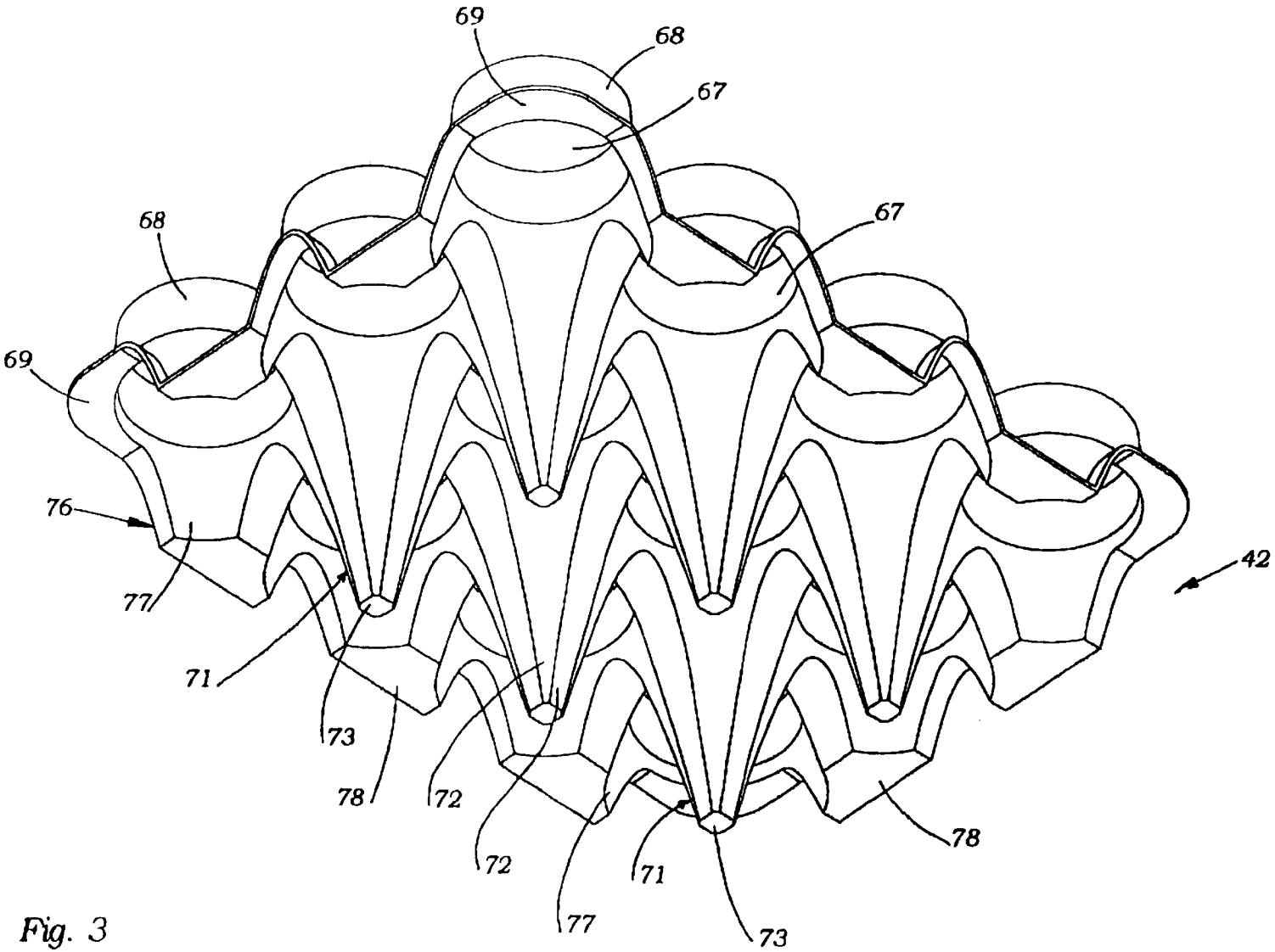
FIG. 3 is an isometric view of the top platform shown in FIG. 1.

More in particular as shown in FIGS. 1, 2 and 3 of the drawings, the packaging 11 of the present invention is for use with glasses of the type having stems and which typically can be called long-stemmed glasses. Each of the glasses 12 is provided with a circular base 13 of solid glass which has a lower flat surface and an upper slightly conical surface. An upwardly-extending solid glass stem 14 adjoins the base 13. The stem 14 is generally cylindrical and is circular in cross section. The stem 14 adjoins a bowl 16 generally having the configuration of an inverted cone circular in cross section which tapers upwardly and outwardly. The bowl 16 terminates in a circular rim 17 lying in a plane parallel to the plane of the lower surface of the base 12 that circumscribes an opening 18 providing access to the interior space 19 of the bowl 16. It should be appreciated that in connection with the present invention, the glasses can be of various sizes and shapes while still utilizing the advantageous features of the packaging hereinafter described.

The packaging 11 includes a case 21 in the form of a parallelepiped having spaced-apart parallel side walls 22 and parallel spaced-apart end walls 26 which adjoin the side walls 22 at right angles thereto. The case 21 also includes a bottom closure 28 and a top closure 29 for closing the top and bottom openings formed by the side walls 22 and the end walls 26. The bottom and top closures 28 and 29 are formed in a conventional manner by the use of parallel spaced-apart major flaps 31 which adjoin the side walls 22 and minor flaps 33 which adjoin the end walls 26. The major and minor flaps 31 and 33 are adapted to be folded over in a conventional manner with the minor flaps being secured to the major flaps in a suitable manner such as by staples or an adhesive (not shown). The case 21 is sized in such a manner so that it can receive a plurality of the glasses 12 as for example three rows with four glasses in each row for a total of twelve glasses in the case.

A base platform 41 is provided within the case 21 and rests on the bottom closure 28 and has the bases 13 of the glasses 12 seated therein. A top platform 42 is also provided within the case 21 and engages the bowls 16 of the glasses 12 to separate the glasses in spaced-apart positions with respect to each other and with respect to the side walls 22 and end walls 26 of the case 21. Similarly, the base platform 41 serves to separate the bases 13 of the glasses 12 in similar spaced-apart positions with respect to each other and also with respect to the side and end walls of the case 21. The base platform 41 and the top platform 42 can be formed of a suitable material such as molded pulp by the use of dies or molds of the type described in co-pending application Ser. No. 09/3585,914, filed Aug. 30, 1999 (A-65271).

The base platform 41 is formed of an integral structure of molded pulp and is provided with a plurality of shallow upwardly facing circular wells 46 which are arranged in rows as for example three rows with four wells in each row. The wells 46 are formed by bottom walls 47 and adjoining upstanding walls 48. The walls 49 adjoin outwardly extending rims 49 extending parallel to the bottom walls 47. These rims 49 in regions adjacent juxtaposed wells 46 adjoin each other to provide a continuous integral construction for the base platform 41.

Upwardly extending pedestals 51 are provided in each location where there are four adjacent juxtaposed wells as shown particularly in FIG. 2. These pedestals 51 are tapered inwardly and upwardly and are provided with four upstanding side walls 52. As shown, each of the side walls is tapered upwardly and inwardly and is slightly concave, conforming to the circle of the well 46 which it abuts. Thus, the pedestals are pyramidal shaped but are truncated to provide a support wall 53 at their top extremities. These pedestals 51 have a predetermined height so that they cooperate with the pedestals provided on the top platform 42 hereinafter described. With the arrangement shown in FIG. 2 it can be seen that there are provided two rows of three pedestals each to provide a plurality of six pedestals, all of which have generally the same configuration and the same height.

In addition as can be seen in FIG. 2, around the outer perimeter of the base platform 41 there are provided additional half pedestals 56 similar to the pedestals 51 but being of lesser height and generally having only two walls 57. The two walls 57 also extend upwardly and are tapered inwardly and upwardly and are provided with a curved surface in the same manner as the pedestals 51. However, as can be seen, only half pedestals 56 are provided because two of the side walls 57 are missing because there are no adjacent wells 46. These pedestals 56 are provided with top walls 59 which serve to reinforce the construction of the shorter pedestals 56.

It can be seen with the construction hereinbefore described that the base platform 41 has an outer configuration which conforms to the bottom closure 28 and is adapted to rest upon the bottom closure 28.

The top platform 42 as shown in FIG. 3 and as hereinbefore described is also formed as an integral structure of molded pulp in the same manner as the base platform 41. It is provided with a plurality of downwardly facing wells 66 which are spaced apart in juxtaposed positions to form three rows of four wells each for a total of twelve wells generally conforming to the pattern of the wells 46 provided in the base platform 41. The wells 66 are provided with a top wall 67 and a downwardly extending side wall 68 for a greater distance than the upstanding wall 48 provided for the wells 46. The wells 66 are generally cylindrical in shape and are adapted to receive the upper extremities of the bowls 16 of the glasses 12. The top platform 42 is provided with rims 69 at the upper extremities adjoining the side walls 68 and extend outwardly therefrom at right angles in a plane parallel to the top walls 67 and adjoin the rims of adjacent wells 66 to provide an integral structure for the top platform 42.

Downwardly extending pyramidal-shaped pedestals 71 similar to the pedestals 51 provided in the base platform 41 are provided as a part of the top platform 42 between each four adjoining wells 66 to provide two rows of three pedestals each. Each of the pedestals 71 is provided with four downwardly extending tapered walls 72 which have inwardly curved surfaces to provide a pyramidal shape which is truncated with a top support wall 73. The pedestals 71 have a certain height so that the top support wall 72 engages the support wall 53 when the top platform 42 is seated on the bowls 16 and the bases of the glasses 12 are seated in the wells 46. The combined height of the pedestals 51 and 71 is such that the top wall 67 of the top platform 42 is out of engagement with the rims 17 of the glasses so that compressive forces applied to the case 21 and to the top platform or conversely to the case 21 and the base platform 41 therein. Thus, the applied compressive forces are absorbed by the pedestals 51 and 71 to thereby prevent such compressive forces being applied to the stems 14 of the glasses 12 and thereby serving to inhibit breakage of the more fragile stems 14. Such compressive forces can occur when the cases 21 are stacked upon one another or when stacked with other types of cases in storage or shipment.

The top platform 42 is also provided with additional half pedestals 76 around the perimeter of the top platform 42 and in alignment with the pedestals 71. These pedestals 76 are provided with tapered side walls 77 which adjoin a top wall 78. Because there are no adjacent wells 67, the pedestals 76 are in effect half pedestals which serve to provide reinforcing for the top platform 42.

Operation and use of the packaging 11 with the base and top platforms 41 and 42 for use therewith may now be briefly described as follows. Let it be assumed that it is desired to provide packaging for glasses having stems such as flute glasses 12 of the type shown in FIG. 1. Typically the glasses 12, as for example twelve glasses, are loaded into the wells 46 provided in the base platform 41. Thereafter, the top platform 42 is inserted over the tops of the glasses 12 and the top platform and is pushed downwardly so that the bowls 16 of the glasses 12 seat within the wells 66 until the pedestals 71 of the top platform come into engagement with the pedestals 51 of the base platform 41. This assembly of the glasses 12 and the base platform 41 and the top platform 42 can then be lowered into the open top side of the case 21 after which the major flaps 31 and minor flaps 33 can be moved into position to close the case in a conventional manner.

Alternatively, the base platform can be inserted into the open ended case 21 and placed on the bottom closure 28 after which the glasses 12 can be inserted into the base platforms and after which the top platform 42 can be placed over the bowls of the glasses with the pedestals 71 engaging the pedestals 51. Thereafter, the top closure can be formed by bringing the major flaps 31 and the minor flaps 33 into a folded relationship to form the top closure 29 in a conventional manner.

Glasses 12 packaged in this manner in the packaging 11 hereinbefore described can more readily withstand compressive forces applied to the cases or cartons during shipment and transport from one location to another. The pedestals 51 and 71 since they are in engagement with each other within the case serve to absorb any compressive forces applied to the case and thereby serve to prevent or at least inhibit compressive forces being applied to the stems 14 of the glasses and thus serving to eliminate or at least greatly reduce the breakage of such type of glasses and particularly the stems during shipment. Upon arrival at the location, the glasses can be readily unpacked by opening the top closure 29 of the case 21 and then removing the top platform 42 after which the glasses 12 can be removed and placed into use.

From the foregoing it can be seen that there has been provided novel packaging for glasses having stems and base and top platforms for use therewith. The base and top platforms are of a type that can be formed of molded pulp and thus can be made relatively inexpensively. The platforms provide the support needed for protecting the stems of the glasses from compressive forces and also for protecting the bowls of the glasses.

What is claimed:

1. Packaging for glasses having stems, the glasses each having a base, a stem mounted on the base and an open bowl mounted on the stem comprising a case in the form of a parallelepiped having parallel spaced-apart side walls and parallel spaced-apart end walls adjoining the side walls at right angles thereto and top and bottom closures to provide an enclosed space for a plurality of juxtaposed glasses disposed in the space within the case, a base platform having a plurality of spaced-apart wells receiving the bases of the glasses, a top platform having a plurality of spaced-apart wells receiving the bowls of the glasses, each of said base platform and said top platform having a plurality of pedestals disposed between the wells and being formed integral therewith, said pedestals having a height so that the pedestals are in engagement with each other to provide support for the glasses to protect the glasses and particularly the stems of the glasses against compressive forces applied to the case and to the base and top platforms to inhibit breakage of the stems of the glasses.

2. Packaging as in claim 1 wherein said pedestals are pyramidal shaped.

3. Packaging as in claim 1 wherein said pedestals are provided with four inclined side walls.

4. Packaging as in claim 3 wherein said side walls have curved outer surfaces.

5. Packaging as in claim 1 wherein said pedestals have support surfaces in engagement with each other.

6. Packaging as in claim 1 wherein each of said base platform and top platform have a plurality of substantially half pedestals spaced about the perimeter of the base and top platforms, said half pedestals having a height less than the height of the first-named pedestals.

7. Packaging as in claim 6 wherein said half pedestals are provided with two sides.

8. Packaging as in claim 1 wherein said base and top platforms are formed of molded pulp.

9. Packaging for glasses having stems, each glass having a base, a stem mounted on the base and an open bowl mounted on the stem comprising a base platform and a top platform disposed over the base platform and providing spaces between the base platform and the top platform for receiving a plurality of the glasses, the base platform comprising a plurality of juxtaposed spaced-apart wells sized to receive the bases of the glasses, said wells being disposed in a plurality of rows, a plurality of pedestals formed integral with the wells and extending above the wells, each of the pedestals being disposed between four adjacent wells to provide a plurality of rows of pedestals, said pedestals being provided with support surfaces at predetermined heights, the top platform comprising a plurality of juxtaposed wells formed in a plurality of rows, the wells of the top platform being sized so as to be adapted to receive the bowls of the glasses, a plurality of pedestals formed integral with the wells of the top platform, said pedestals of the too platform being positioned between four adjacent wells of the top platform to provide a plurality of rows of pedestals, said pedestals of the top platform being provided with support surfaces engaging the support surfaces of the pedestals of the base platform to thereby provide support for glasses disposed in the spaces to protect the glasses and particularly the stems of the glasses against compressive forces applied to the base platform and the top platform.

10. Packaging as in claim 9 wherein each of said pedestals is pyramidal shaped and is provided with four tapered walls.

11. Packaging as in claim 10 wherein said walls are provided with a concave outer surface.

12. Packaging as in claim 9 further including a plurality of half pedestals disposed around the perimeters of the bottom and top platforms.

13. Packaging as in claim 12 wherein said half pedestals are pyramidal shaped and are provided with two sides.

14. Packaging as in claim 9 which is formed of molded pulp.

* * * * *